United States Patent [19]

Hedge

[11] 4,109,664

[45] Aug. 29, 1978

[54] SMOKING MATERIALS

[75] Inventor: Roger W. Hedge, Lymington, England

[73] Assignee: Brown & Williamson Tobacco Corporation, Louisville, Ky.

[21] Appl. No.: 773,342

[22] Filed: Mar. 1, 1977

Related U.S. Application Data

[63] Continuation-in-part of Ser. No. 555,603, Mar. 5, 1975, abandoned.

[51] Int. Cl.[2] ..... A24D 1/18

[52] U.S. Cl. ..... 131/2

[58] Field of Search ..... 131/2, 17, 15, 140 R, 131/140 C, 62, 140 P

[56] References Cited

U.S. PATENT DOCUMENTS

| | | | |
|---|---|---|---|
| 2,887,414 | 5/1959 | Rosenberg et al. | 131/17 R |
| 3,310,058 | 3/1967 | Savage et al. | 131/17 R |
| 3,398,754 | 8/1968 | Tughan | 131/140 C X |
| 3,528,434 | 9/1970 | Halter et al. | 131/140 C |
| 3,593,721 | 7/1971 | Knop et al. | 131/17 AC |
| 3,613,693 | 10/1971 | Monte | 131/140 C X |
| 3,872,871 | 3/1975 | Fiore et al. | 131/140 P |
| 3,885,574 | 5/1975 | Borthwick et al. | 131/17 R |
| 3,931,824 | 1/1976 | Miano et al. | 131/2 |
| 3,968,804 | 7/1976 | Kelly et al. | 131/17 A |

FOREIGN PATENT DOCUMENTS

| | | | |
|---|---|---|---|
| 382,633 | 8/1922 | Fed. Rep. of Germany | 131/140 P |

OTHER PUBLICATIONS

*Tobacco & Tob. Smoke* by Wynder & Hoffman, 1967, Academic Press, p. 350 cited.

*The Chemistry & Technology of Tobacco* vol. III by Shmuk Publ. by Pishchepromizdat, Moscow, USSR, 1953, pp. 602 & 603 cited.

*Dangerous Prop. of Industrial Materials* by Sax, 3rd Edition, Reinold Publ. 1969, p. 461 cited.

*Primary Examiner*—Robert W. Michell

*Assistant Examiner*—V. Millin

*Attorney, Agent, or Firm*—William J. Mason; Charles G. Lamb

[57] ABSTRACT

A smoking material comprises a binder consisting wholly or in part of a thermo-gelling substituted cellulose having a degree of substitution of at least 1.5 methoxyl groups per anhydroglucose unit, and an inert water-insoluble inorganic diluent such as chalk, which material has a density reduced by the entrainment and dispersion of air therein. The binder may comprise a thermo-gelling methyl cellulose having a degree of substitution of at least 1.5 methoxyl groups per anhydroglucose unit and/or an additionally substituted methyl cellulose having a degree of substitution of at least 1.5 methoxyl groups per anhydroglucose unit. It may additionally include a thermo-gelling cellulose having a lower degree of substitution or a non-thermo-gelling substituted cellulose.

10 Claims, 1 Drawing Figure

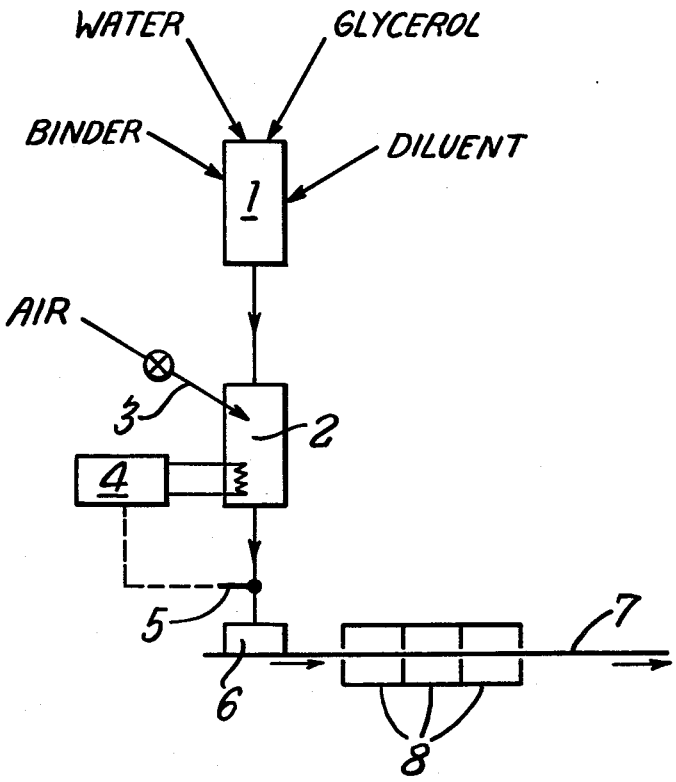
WATER
GLYCEROL
BINDER
DILUENT
1
AIR
3
2
4
5
7
6
8

SMOKING MATERIALS

CROSS-REFERENCE TO RELATED APPLICATION

This application is a continuation-in-part of copending application Ser. No. 555,603 filed Mar. 5, 1975 now abandoned.

BACKGROUND OF THE INVENTION

Field of the Invention

This invention concerns improvements relating to smoking materials intended to be used as tobacco substitutes either alone or in conjunction with tobacco or reconstituted tobacco or other smoking materials. It is an object of this invention to provide such advantageous materials, but of low density, and a method for their production.

SUMMARY OF THE INVENTION

In accordance with the invention, a smoking material comprises a binder consisting wholly or in part of a thermogelling substituted cellulose having a degree of substitution of at least 1.5 methoxyl groups per anhydroglucose units, and an inert water-insoluble inorganic diluent, which material has a density reduced by the entrainment and dispersion of air therein. The density should be reduced solely or substantially solely by such air entrainment and dispersion.

The smoking material may also comprise a content of caramel and/or tobacco extract. It may further contain a humectant, such as glycerol or sorbitol or other material well known in the art.

DETAILED DESCRIPTION OF THE INVENTION

By a thermo-gelling substituted cellulose is meant one which forms a thermo-gelling solution in water, that is a solution whose viscosity increases sharply with increasing temperature in a particular temperature range dependent on the substance. The thermo-gelling substituted cellulose employed may be methyl cellulose and/or an additionally substituted methyl cellulose having at least the aforesaid degree of substitution. Such methyl cellulose may be used in admixture either with a methyl cellulose of lower methoxyl content or with a non thermo-gelling substituted cellulose such as sodium carboxymethyl cellulose. The purpose of the invention cannot be satisfied in such admixtures in the absence from the binder of at least a proportion, say one tenth, of thermo-gelling methyl cellulose or additionally substituted methyl cellulose of at least the aforesaid methoxyl content. By additionally substituted methyl cellulose is meant a methyl cellulose containing a proportion of carboxymethyl or other like substituents. A sufficiently high methoxyl content for the purposes of the invention will generally be a degree of substitution referred to as "high" by manufacturers of such products, this degree of substitution usually being in the range of 1.5 to 2.4 methoxyl units per anhydroglucose units. Because of the nature of these products, which are intrinsically variable, the exact degree of substitution cannot always be stated, but only a range over which suitable properties can be obtained.

Also in accordance with the invention, a method of producing such a smoking material comprises mixing a binder consisting wholly or in part of a thermo-gelling substituted cellulose having a degree of substitution of at least 1.5 methoxyl groups per anhydrous units with an inert water-insoluble inorganic diluent and reducing the density of the material by entraining and dispersing air in the mixture.

Suitably, a planetary mixer is used to disperse and dissolve the constituents in water prior to the bringing of the material to a state of suitable use in a smoking mixture. This type of mixer itself whips a proportion of air into the slurry being prepared. However, an acceptably uniform product containing air bubbles, preferably small closed bubbles, in large numbers cannot be so obtained. It is necessary and indeed advantageous to utilize a high-shear mixer, for example the E. T. Oakes continuous automatic mixer, which has provision for the introduction of a controlled further quantity of air, over and above such air as may be introduced by the action of the planetary mixer, as well as provision for circulating temperature-controlled hot water through the jacket of the mixer head. Advantageously, the mixture is brought to a temperature in the range of 35° to 60° C. The effect of the high shear mixer is principally a reduction in air-bubble size. The maximum bubble size should be less than the thickness, and preferably less than half the thickness, of the sheet material to be produced, so that, substantially, the bubbles do not break the surface of the sheet. By the aforesaid method, a uniform foam material with closed cells can be reliably reproduced without the use of additional foaming, blowing or like agents and without the necessity for close observance of conditions involved in foaming or blowing with the use of such agents. The closed cell product has good flexibility and produces a minimum of waste in processing during cigarette manufacture.

The inert inorganic diluent or filler is advantageously calcium carbonate (chalk or whiting), but other compounds such as calcium sulphate (gypsum), calcium phosphate, aluminium trihydrate, aluminates or the like may be used, provided they are insoluble in water.

The composition may comprise also a content of caramel or tobacco extract. Caramel may serve as a complete or partial replacement for tobacco extract known as a constituent of tobacco substitutes. The composition may further comprise a content of humectant such as glycerol. The composition need contain no other constituents.

Suitable proportions of the constituents by weight are, for example:

- Binder, 5 to 15%, in which the substituted cellulose of the aforesaid high methoxyl content should be from 10 to 100% of the binder. Preferably the binder content is from 7 to 13%.
- Caramel and/or tobacco extract, 2 to 20%, but preferably 8 to 16%.
- Inert inorganic diluent, 60 to 90%, but preferably 75 to 85%.
- Humectant, 1 to 10%, but preferably 2 to 6%.

If such a composition is used shredded in mixture with cut tobacco and/or reconstituted tobacco, the proportion of the composition in the mixture may be within the range of 1 to 99%, but usually in the range of 5 to 75%, by weight.

The following Examples illustrate how the invention may be carried into effect.

EXAMPLE 1

0.5 parts of B.P. grade glycerol were added to 51 parts of water in the bowl of a Hobart planetary mixer having a gate-type beater blade, followed by the addition of 1.6 parts of a commercially available sodium carboxymethyl methyl cellulose (Grade C7501, Henkle Chemicals Ltd., having a viscosity 2,300 cps, approximately, in 2% solution in water at 20° C according to the method of Brookfield, and an average methoxyl degree of substitution of 1.67, together with a low, unspecified, degree of substitution of sodium carboxymethyl groups per anhydroglucose unit). The mixture was stirred for one hour before the addition of 15.2 parts of commercial whiting (high purity, 90% smaller than BS 200 mesh). The slurry was stirred for a further two hours in the same mixer and the resultant slurry was then fed through an Oakes highshear continuous automatic mixer with controllable air injection and provision for circulating temperature-controlled hot water through the jacket of the mixer head. The rotor speed of the Oakes mixer and the temperature of the circulated water were adjusted so that the aerated slurry was delivered at a temperature of 42° C.–48° C. to a gate coater and was cast as a sheet on an endless stainless steel band passing through a series of drying chambers, as commonly used in the manufacture of tobacco-sheet products, the air temperature ranging from 80° C. to 110° C. with provision for underband steam heating. The minimum rotor speed of the Oakes mixer to give suitable small air bubbles was 250 rpm. At the maximum air-feed rate to the Oakes mixer at which a coherent product could be formed in this Example the sheet produced had a specific gravity of 0.25, and specific gravities increasing to 0.75 were produced as the air-injection flow rate was progressively reduced.

EXAMPLE 2

The procedure of Example 1 was followed, except that 0.5 parts of glycerol were added to 60 parts of water followed by the addition of 2.75 parts of sodium carboxymethyl methyl cellulose (Grade C7501, Henkel Chemicals Ltd.) which, after one hour of mixing, was followed by the simultaneous addition of 2.5 parts of caramel (65% solids) and 19.25 parts of the whiting. Cast sheets were produced, as in Example 1, with specific gravities in the range of 0.3 to 0.8.

EXAMPLE 3

The procedure of Example 1 was followed, except that 0.5 parts of glycerol were added to 60 parts of water followed by the addition of 0.75 parts of the sodium carboxymethyl methyl cellulose (Grade C7501, Henkel Chemicals Ltd.), and 2 parts of methyl cellulose (Grade M2500, British Celanese Ltd., viscosity 2,200–2,800 cps in 2% solution in water at 20° C. by the method of Ostwald, specified as having a medium degree of methoxyl substitution, the average being in the range of 1.5 to 1.9 methoxyl groups per anhydroglucose unit). After one hour of mixing, 2.5 parts of caramel (65% solids) and 19.25 parts of the whiting were added. Sheets were produced, as in Example 1, with specific gravities over the range 0.4 to 0.8.

EXAMPLE 4

The procedure of Example 1 was followed, except that 0.5 parts of glycerol were added to 60 parts of water followed by the addition of 0.75 parts of methyl cellulose (Grade C2026, Henkel Chemicals Ltd., viscosity 2000–3000 cps in 2% solution in water at 20° C., specified as having a high degree of methoxyl substitution, with an average of 1.8 methoxyl groups per anhydroglucose unit), and 2 parts of methyl cellulose (Grade M2500, British Celanese Ltd.). After one hour of mixing 2.5 parts of caramel (65% solids) and 19.25 parts of the whiting were added. Sheets were produced as in Example 1, with specific gravities over the range 0.4 to 0.8.

EXAMPLE 5

The procedure of Example 1 was followed, except that 0.5 parts of glycerol were added to 60 parts of water followed by 0.75 parts of sodium carboxymethyl methyl cellulose (Grade C7501, Henkel Chemicals Ltd.) and 2 parts of sodium carboxymethyl cellulose (Grade F100, British Celanese Ltd., 80–120 cps in 1% solution in water at 25° C. by the method of Ostwald, with a degree of substitution of 0.5 to 0.7 carboxymethyl groups per anhydroglucose unit). After one hour of mixing, 2.5 parts of caramel (65% solids) and 19.25 parts of the whiting were added. Sheets were produced as in Example 1 with specific gravities over the range 0.4 to 0.8.

EXAMPLE 6

The procedure of Example 1 was followed, except that 0.5 parts of glycerol were added to 60 parts of water containing 1.25 parts (dry weight) of aqueous tobacco extractables followed by 0.75 parts of sodium carboxymethyl methyl cellulose (Grade C7501, Henkel Chemicals Ltd.) and 2 parts of sodium carboxymethyl cellulose (Grade F100, British Celanese Ltd.). After one hour of mixing, 1.25 parts of caramel (65% solids) and 19.25 parts of the whiting were added. Sheets were produced as in Example 1 with specific gravities over the range 0.5 to 0.9.

EXAMPLE 7

The procedure of Example 1 was followed, except that 0.5 parts of glycerol were added to 60 parts of water followed by 0.75 parts of sodium carboxymethyl methyl cellulose (Grade C7501, Henkel Chemicals Ltd.) and 2 parts of sodium carboxymethyl cellulose (Grade F8, British Celanese Ltd., viscosity 5–9 cps in 1% solution in water at 25° C. by the method of Ostwald, with a degree of substitution of 0.5 to 0.7 carboxymethyl groups per anhydroglucose unit). After one hour of mixing, 2.5 parts of caramel (65% solids) and 19.25 parts of the whiting were added. Sheets were produced as in Example 1 with specific gravities over the range 0.3 to 0.8.

EXAMPLE 8

The procedure of Example 1 was followed except that 0.5 parts of glycerol were added to 60 parts of water followed by 2 parts of sodium carboxymethyl methyl cellulose (Grade C7501, Henkel Chemicals Ltd.) and 0.75 parts of sodium carboxymethyl cellulose (Grade F100, British Celanese Ltd.). After one hour of mixing, 2.5 parts of caramel (65% solids) and 19.25 parts of the whiting were added. Sheets were produced as in Example 1 with specific gravities over the range 0.25 to 0.7.

EXAMPLE 9

The procedure of Example 1 was followed, except that 0.5 parts of glycerol were added to 60 parts of water followed by 2 parts of sodium carboxymethyl methyl cellulose (Grade C7501, Henkel Chemicals Ltd.) and 0.75 parts of methyl cellulose (Grade M2500, British Celanese Ltd.). After 1 hour of mixing, 2.5 parts of caramel (65% solids) and 19.25 parts of the whiting were added. Sheets were produced as in Example 1 with specific gravities over the range 0.3 to 0.7.

EXAMPLE 10

The procedure of Example 1 was followed, except that 0.5 parts of glycerol were added to 60 parts of water followed by 0.275 parts of sodium carboxymethyl methyl cellulose (grade C7501, Henkel Chemicals Ltd.) and 2.475 parts of methyl cellulose (Grade M2500, British Celanese Ltd.). After one hour of mixing, 2.5 parts of caramel (65% solids) and 19.25 parts of the whiting were added. Sheets were produced as in Example 1 with specific gravities over the range 0.4 to 0.8.

EXAMPLE 11

The procedure of Example 1 was followed, except that 0.5 parts of glycerol were added to 60 parts of water followed by 0.35 parts of sodium carboxymethyl methyl cellulose. (Grade C7501, Henkel Chemicals Ltd.) and 1.40 parts of methyl cellulose (Grade M2500, British Celanese Ltd.). After 1 hour of mixing, 2.5 parts of caramel (65% solids) and 19.25 parts of the whiting were added. Sheets were produced as in Example 1 with specific gravities over the range 0.4 to 0.8.

EXAMPLE 12

The procedure of Example 1 was followed, except that 0.5 parts of glycerol was added to 60 parts of water followed by 0.275 parts of sodium carboxymethyl methyl cellulose (Grade C7501, Henkel Chemicals Ltd.) and 2.475 parts of sodium carboxymethyl cellulose (Grade F100, British Celanese Ltd.). After mixing for 1 hour, 2.5 parts of caramel (65% solids) and 19.25 parts of the whiting were added. Sheets were produced as in Example 1 with specific gravities over the range 0.4 to 0.8.

EXAMPLE 13

The procedure of Example 1 was followed, except that the whiting was replaced by the same amount of aluminium trihydrate of similar particle size. Sheets were produced as in Example 1 with specific gravities over the range 0.4 to 0.8.

EXAMPLE 14

The procedure of Example 3 was followed, except that the whiting was replaced by the same amount of aluminium trihydrate of similar particle size. Sheets were produced as in Example 1 with specific gravities over the range 0.4 to 0.8.

EXAMPLE 15

The procedure of Example 1 was followed, except that 1 part of glycerol was added to 60 parts of water followed by 0.6 parts of methyl cellulose (Grade C2026, Henkel Chemicals Ltd.), and 2.5 parts of sodium carboxymethyl cellulose (Grade F100, British Celanese Ltd.). After mixing for 1 hour, 2 parts of caramel (65% solids) and 19 parts of the whiting were added. Sheets were produced as in Example 1 with specific gravities over the range 0.4 to 0.8.

EXAMPLE 16

The procedure of Example 1 was followed, except that 0.5 parts of glycerol were added to 60 parts of water followed by the addition of 2.75 parts of methyl cellulose (Grade MMPR2, British Celanese Ltd., viscosity 450–550 cps in 1.5% solution in 80:20 v/v methylene chloride:methanol at 20° C., specified as having a high degree of methoxyl substitution, the average being in the range 1.5 to 1.9 methoxyl groups per anhydroglucose unit). After mixing for 1 hour, 2.5 parts of caramel (65% solids) and 19.25 parts of the whiting were added. Sheets were produced as in Example 1, with specific gravities over the range 0.4 to 0.8.

EXAMPLE 17

The procedure of Example 1 was followed, except that 0.5 parts of glycerol were added to 60 parts of water followed by the addition of 2.75 parts of methyl cellulose (Grade M2500, British Celanese Ltd.). After mixing for one hour, 2.5 parts of caramel (65% solids) and 19.25 parts of the whiting were added. Sheets were produced as in Example 1 with specific gravities over the range 0.4 to 0.8.

EXAMPLE 18

The procedure of Example 1 was followed, except that 0.5 parts of glycerol was added to 80 parts of water followed by the addition of 2.75 parts of methyl cellulose (Grade MC4000, Dow Chemical Company, viscosity 3500–5000 cps in 2% solution in water at 20° C. according to the method of Ubbelohde, and an average methoxyl degree of substitution of 1.6 to 1.85 methoxyl groups per anhydroglucose unit). After mixing for 1 hour, 2.5 parts of caramel (65% solids) and 19.25 parts of whiting were added. Sheets were produced as in Example 1 with specific gravities over the range 0.5 to 0.9.

The accompanying diagrammatic drawing illustrates the combination of apparatus referred to in the Examples:

Water and glycerol, followed by binder and inorganic diluent are mixed in a planetary mixer 1. The mixture is passed to a continuous high-shear mixer 2 with provision indicated at 3 for the controlled introduction of air and means indicated at 4 for the circulation through the mixer head of a temperature-control fluid, the temperature being controlled by a temperature-measuring device 5. The mixer 2 delivers to a gate coater 6 by which the mixture, at the controlled temperature, is applied to a continuously moving steel band 7 on which it is carried through a series of drying chambers 8. The casting and drying apparatus may be of conventional type as used in the known production of reconstituted tobacco-sheet products.

EXAMPLE 19

The formulation of Example 5, supra, is used to produce cast dry product sheet of specific gravity 0.46 and this sheet is sliced and diced to produce pieces approximately 50mm. square. These pieces are mixed in known manner with moistened tobacco lamina blend and cut together at 34 cpi in the known manner. The cut product is mixed with shredded rolled stem blend and the final mixture is dried and made into filter cigarettes. These cigarettes contain 30% of the product of the invention and 70% of tobacco mixture. These cigarettes were compared with an all-tobacco cigarette containing 100% of the same tobacco mixture prepared in a like manner. A panel of trained smokers found the cigarettes containing the product of my invention to have reduced irritant characteristics and that the cigarettes were wholly acceptable from a smoke taste point of view. They felt no ill effect from smoking the cigarettes.

I claim:

1. A tobacco substitute, which comprises; a mixture of (a) a binder which comprises a water-soluble, thermo-gelling, methoxyl-substituted cellulose having a methoxyl degree of substitution of at least 1.5 groups per anhydroglucose unit;

(b) a water-insoluble, inorganic diluent, said binder amounts to 7 to 13% and the diluent to 75 to 85% by weight of the tobacco substitute; and (c) closed air cells dispersed throughout the mixture of (a) and (b).

2. A tobacco substitute according to claim 1, wherein the binder comprises an additionally substituted methyl cellulose having a degree of substitution of at least 1.5 methoxyl groups per anhydroglucose unit.

3. A tobacco substitute according to claim 1, wherein the binder comprises, in addition to the said thermo-gelling cellulose, a thermo-gelling cellulose having a lower degree of substitution.

4. A tobacco substitute according to claim 1, wherein the binder comprises, in addition to the said thermo-gelling cellulose having a high degree of substitution, a non-thermogelling substituted cellulose.

5. A tobacco substitute according to claim 1 and comprising also an additive content from the group consisting of caramel and tobacco extract.

6. A tobacco substitute according to claim 1, wherein at least one tenth of the binder is a thermo-gelling substituted cellulose having a degree of substitution of at least 1.5 methoxyl groups per anhydroglucose unit.

7. The tobacco substitute of claim 1, wherein said binder comprises 5 to 15% of said tobacco substitute, which binder consists of at least 10% thermo-gelling substituted cellulose having a degree of substitution of at least 1.5 methoxyl groups per anhydroglucose unit.

8. A method of producing a tobacco substitute which comprises:

a. forming an aqueous mixture by mixing (i) water, (ii) a binder consisting at least in part of a water-soluble thermo-gelling substituted cellulose having a degree of substitution of at least 1.5 methoxyl groups per anhydroglucose unit, and (iii) an inert water-insoluble inorganic diluent, said binder amounts to 7 to 13% and the diluent to 75 to 85% by weight of the mixture;

b. reducing the density of the mixture by entraining and dispersing air therein by introducing air and subjecting said mixture to high shear mixing;

c. forming said mixture into a sheet; and d. drying said sheet.

9. A method accodring to claim 8, wherein the mixture is brought to a temperature in the range of 35° to 60° C.

10. A method according to claim 8, wherein the substitute is produced from the mixture by a drying operation, the entrainment and dispersion of the air being performed prior to the said drying operation.

* * * * *